US008517512B2

(12) United States Patent
Fujii et al.

(10) Patent No.: US 8,517,512 B2
(45) Date of Patent: Aug. 27, 2013

(54) FLOW CHANNEL STRUCTURE, METHOD OF MANUFACTURING SAME, AND LIQUID EJECTION HEAD

(75) Inventors: Takamichi Fujii, Kanagawa (JP); Akihiro Mukaiyama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/406,303

(22) Filed: Feb. 27, 2012

(65) Prior Publication Data

US 2012/0218352 A1 Aug. 30, 2012

(30) Foreign Application Priority Data

Feb. 28, 2011 (JP) ..... 2011-042512

(51) Int. Cl.
*B41J 2/14* (2006.01)

(52) U.S. Cl.
USPC ..... 347/47

(58) Field of Classification Search
USPC ..... 347/47, 20, 44, 54, 71
See application file for complete search history.

(56) References Cited

FOREIGN PATENT DOCUMENTS

| | | | |
|---|---|---|---|
| JP | 8-168889 A | | 7/1996 |
| JP | 2007062126 | * | 3/2007 |
| JP | 2007269011 | * | 10/2007 |

* cited by examiner

*Primary Examiner* — Matthew Luu
*Assistant Examiner* — Michael Konczal
(74) *Attorney, Agent, or Firm* — Birch, Stewart, Kolasch & Birch, LLP.

(57) ABSTRACT

A flow channel structure includes: a first substrate in which a first flow channel section is arranged; a first adhesive layer which is arranged on the first substrate; a first noble metal layer containing gold and arranged over the first adhesive layer on the first substrate; a second substrate in which a second flow channel section is arranged; a second adhesive layer arranged on the second substrate; a second noble metal layer containing gold and arranged over the second adhesive layer on the second substrate; and an Au tubular structure disposed between the first and second noble metal layers which face to each other across the Au tubular structure, the Au tubular structure having a hollow portion serving as a connecting flow channel section which connects the first and second flow channel sections, a gold content of the Au tubular structure being not lower than 90 at. %.

10 Claims, 3 Drawing Sheets

FLOW CHANNEL STRUCTURE, METHOD OF MANUFACTURING SAME, AND LIQUID EJECTION HEAD

BACKGROUND OF THE INVENTION

1. Field of the Invention

The present invention relates to a flow channel structure, a method of manufacturing same, and a liquid ejection head, and more particularly to a structure suitable for a flow channel through which liquid such as ink passes, and technology for manufacturing same.

2. Description of the Related Art

Japanese Patent Application Publication No. 08-168889 discloses technique for bonding metallic members by means of Au—Sn (gold-tin) alloy and technique for manufacturing an inkjet print head employing this bonding technique, and describes that a structure manufactured by bonding layers of members with the bonding technique by means of Au—Sn alloy is known in the technical field of micro electro mechanical systems (MEMS).

For example, if ink flow channels for an inkjet method are manufactured by using a structure manufactured by employing the above-described bonding technique, then depending on the type of ink solution passing through the flow channels, components of the flow channel structure such as Sn dissolve into the ink, thus degrading the flow channel structure and causing leakage of the ink, and so on.

SUMMARY OF THE INVENTION

The present invention has been contrived in view of these circumstances, an object thereof being to provide a stable flow channel structure which has high durability and remains free from leakages, and the like, over a long period of time, a method of manufacturing the flow channel structure, and a liquid ejection head including the flow channel structure.

In order to attain the aforementioned object, the present invention is directed to a flow channel structure, comprising: a first substrate in which a first flow channel section is arranged; a first adhesive layer which is arranged on the first substrate; a first noble metal layer which contains gold and is arranged over the first adhesive layer on the first substrate; a second substrate in which a second flow channel section is arranged; a second adhesive layer which is arranged on the second substrate; a second noble metal layer which contains gold and is arranged over the second adhesive layer on the second substrate; and an Au tubular structure which is disposed between the first and second noble metal layers which face to each other across the Au tubular structure, the Au tubular structure having a hollow portion serving as a connecting flow channel section which connects the first and second flow channel sections, a gold content of the Au tubular structure being not lower than 90 atomic percent (at. %).

According to this aspect of the present invention, the flow channel is formed with the first flow channel section, the hollow portion of the Au tubular structure (connecting flow channel section) and the second flow channel section, which are sequentially connected. According to this aspect of the present invention, the adhesiveness between the Au tubular structure and the respective substrates is high, and the flow channel structure having good durability can be formed.

Preferably, the first flow channel section, the hollow portion of the Au tubular structure and the second flow channel section form a flow channel through which liquid passes.

According to this aspect of the present invention, it is possible to use the structure as flow channels through which various liquids pass, irrespective of the liquid type, such as alkaline or acidic liquids.

Preferably, the gold content of the Au tubular structure is not lower than 99 at. %.

From the viewpoint of liquid resistance, and the like, it is more desirable that the content of Au is higher.

Preferably, the Au tubular structure is formed by molding Au powder and then heating and compressing the molded Au powder.

For example, the Au powder is molded in a prescribed mold, and then the molded Au powder is applied with heat and pressure to compress the molded Au powder to obtain the Au tubular structure.

Preferably, each of the first and second substrates is made of silicon.

According to this aspect of the present invention, it is possible to perform highly fine processing using semiconductor manufacturing technology.

Preferably, each of the first and second adhesive layers contains one of titanium, nickel, chromium and zirconium. These materials are suitable as an adhesive layer.

Preferably, the flow channel structure further comprises: a first diffusion blocking layer which is arranged between the first noble metal layer and the first adhesive layer, the first diffusion blocking layer preventing diffusion of gold atoms from the first noble metal layer into the first adhesive layer; and a second diffusion blocking layer which is arranged between the second noble metal layer and the second adhesive layer, the second diffusion blocking layer preventing diffusion of gold atoms from the second noble metal layer into the second adhesive layer.

According to this aspect of the present invention, by arranging the diffusion blocking layer between the noble metal layer and the adhesive layer, it is possible to achieve even higher durability.

Preferably, each of the first and second diffusion blocking layers contains one of platinum, iridium and ruthenium or any oxide of platinum, iridium and ruthenium. These materials are suitable as the diffusion blocking layers.

Preferably, when each of a first interface between the Au tubular structure and the first noble metal layer and a second interface between the Au tubular structure and the second noble metal layer is observed in a cross section taken along an axis of the hollow portion of the Au tubular structure, a ratio R of bonded portions is not lower than 50% in each of the first and second interfaces, where the ratio R is defined as $R(\%)=(L1/L)\times 100$, L is a whole length of each of the first and second interfaces in the cross section within a field of view, and L1 is a total of lengths, taken along each of the first and second interfaces in the cross section within the field of view, of portions at which the Au tubular structure is bonded to corresponding one of the first and second noble metal layers.

According to this aspect of the present invention, it is possible to form a stable flow channel which is free of leaks.

The ratio R of bonded portions is more desirably not lower than 60%, and the higher, the better.

In order to attain the aforementioned object, the present invention is also directed to a liquid ejection head, comprising: the above-described flow channel structure; a pressure chamber which is configured to store liquid and is connected to a flow channel constituted of the flow channel structure through which the liquid is supplied to the pressure chamber; a nozzle which is configured to be an ejection port through which the liquid in the pressure chamber is ejected; and an ejection energy generating element which is arranged correspondingly to the pressure chamber and is configured to generate energy for ejecting a droplet of the liquid through the nozzle.

In order to attain the aforementioned object, the present invention is also directed to a method of manufacturing a flow channel structure, the method comprising: a first adhesive layer formation step of forming a first adhesive layer on a first substrate; a first noble metal layer formation step of forming a first noble metal layer over the first adhesive layer on the first substrate, the first noble metal layer containing gold; an Au tubular structure precursor formation step of forming an Au tubular structure precursor on the first noble metal layer by molding Au powder, the Au tubular structure precursor having a hollow portion; a first through hole formation step of forming, in the first substrate, a first through hole configured to be connected to the hollow portion of the Au tubular structure precursor; a second adhesive layer formation step of forming a second adhesive layer on a second substrate; a second noble metal layer formation step of forming a second noble metal layer over the second adhesive layer on the second substrate, the second noble metal layer containing gold; a second through hole formation step of forming, in the second substrate, a second through hole configured to be connected to the hollow portion of the Au tubular structure precursor; and a bonding step of arranging the first and second substrates to bring the Au tubular structure precursor into contact with the second noble metal layer while aligning the hollow portion of the Au tubular structure precursor and the second through hole to each other, and then heating and compressing the Au tubular structure precursor to form an Au tubular structure through which the first and second substrates are bonded with each other, whereby the flow channel structure is formed with a flow channel in which the first and second through holes are connected through a hollow portion of the Au tubular structure deriving from the hollow portion of the Au tubular structure precursor.

According to this aspect of the present invention, it is possible to obtain a good flow channel structure having high durability.

Preferably, the method further comprises: between the first adhesive layer formation step and the first noble metal layer formation step, a first diffusion blocking layer formation step of forming a first diffusion blocking layer over the first adhesive layer, the first noble metal layer being formed on the first diffusion blocking layer in the first noble metal layer formation step, the first diffusion blocking layer preventing diffusion of gold atoms from the first noble metal layer into the first adhesive layer; and between the second adhesive layer formation step and the second noble metal layer formation step, a second diffusion blocking layer formation step of forming a second diffusion blocking layer over the second adhesive layer, the second noble metal layer being formed on the second diffusion blocking layer in the second noble metal layer formation step, the second diffusion blocking layer preventing diffusion of gold atoms from the second noble metal layer into the second adhesive layer.

According to this aspect of the present invention, it is possible to achieve even greater improvement in durability.

According to the present invention, it is possible to obtain stable flow channels which have high durability and remain free of leakages, and the like, over a long period of time, by means of the composition including the Au tubular structure.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
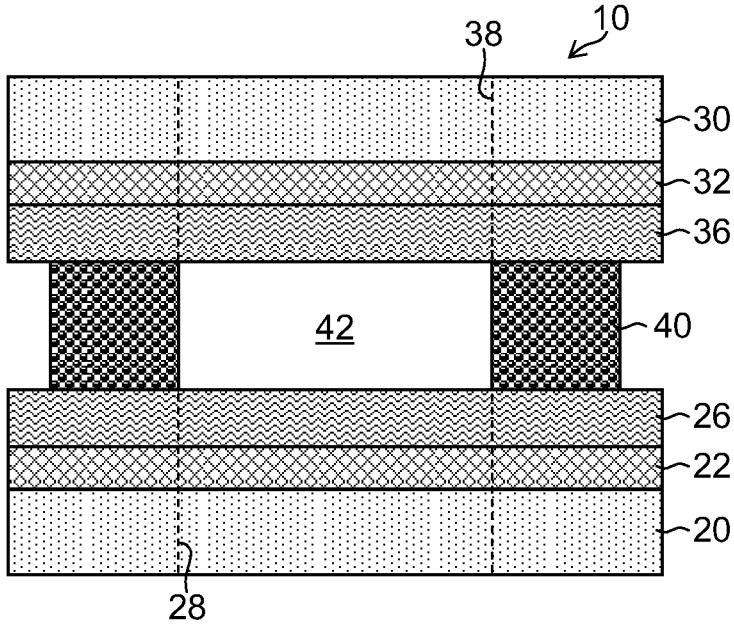
FIG. 1 is a cross-sectional diagram showing a composition of a flow channel structure according to a first embodiment of the present invention.

FIG. 1 is a cross-sectional diagram showing a composition of a flow channel structure according to a first embodiment of the present invention. The flow channel structure 10 includes a first substrate 20, a second substrate 30, and an Au (gold) tubular structure 40, which has a tubular shape and is disposed between the first substrate 20 and the second substrate 30. A first adhesive layer 22 and a first Au layer 26 are arranged on the first substrate 20, and the lower end of the Au tubular structure 40 is bonded to the first substrate 20 through the first Au layer 26. Similarly, a second adhesive layer 32 and a second Au layer 36 are arranged on the second substrate 30, and the upper end of the Au tubular structure 40 is bonded to the second substrate 30 through the Au layer 36.

A first through hole 28 is formed through the first substrate 20, the first adhesive layer 22 and the first Au layer 26. A second through hole 38 is formed through the second substrate 30, the second adhesive layer 32 and the second Au layer 36. The first and second through holes 28 and 38 are in connection with a hollow portion 42 of the Au tubular structure 40. In FIG. 1, for the sake of the drawing, the hollow portions of the first and second through holes 28 and 38 are not depicted, and the side wall faces of the first and second through holes 28 and 38 are shown with dashed lines.

The first through hole 28 serves as a first flow channel portion, and the second through hole 38 serves as a second flow channel portion. The first Au layer 26 serves as a first noble metal layer, and the second Au layer 36 serves as a second noble metal layer. The first and second Au layers 26 and 36 have effects of improving the affinity (bonding characteristics) with the Au tubular structure 40. Similar effects are obtained provided that the noble metal layers are mainly composed of Au. It is also possible that the noble metal layers are composed of platinum (Pt), iridium (Ir), ruthenium (Ru), and the like. It is desirable that the Au content of the noble metal layers is high, more specifically not lower than 50 atomic percent (at. %).

The first and second substrates 20 and 30 are desirably silicon (Si) substrates. It is desirable that each of the first and second adhesive layers 22 and 32, which are arranged respectively between the Au layers 26 and 36 and the Si substrates 20 and 30, contains at least one of titanium (Ti), nickel (Ni), chromium (Cr) and zirconium (Zr).

The Au content of the Au tubular structure 40 is desirably not lower than 90 at. %, more desirably not lower than 95 at. %, and yet more desirably not lower than 99 at. %. The Au tubular structure 40 of this kind can be manufactured by a sintering process, for example, by molding Au powder (e.g., Au powder having an average particle size of the sub-micrometer order) to a desired shape, and then heating and compressing the molded Au powder to form an Au solid body.

The Au tubular structure 40 is not limited to a round tubular shape and can be a polygonal tubular shape. Moreover, there are no particular restrictions on the cross sectional shape of the flow channel of the hollow portion 42, through which the liquid passes; and various shapes, such as a circular shape, an oval shape, a square shape, a hexagonal shape or another polygonal shape, or the like, can be used. The Au tubular structure 40 serves as a connecting flow channel which connects the first through hole 28 and the second through hole 38.

By means of the structure shown in FIG. 1, the first through hole 28, the hollow portion 42 of the Au tubular structure 40, and the second through hole 38 are linearly connected to compose the flow channel, through which liquid such as ink can flow. Although only one flow channel is shown in FIG. 1, a plurality of similar flow channels through which the liquid can pass are formed between the first and second substrates 20 and 30.

There are no particular restrictions on the direction in which the liquid flows, and the liquid can flow from top to bottom in FIG. 1 (from the second through hole 38 to the first through hole 28), or in the opposite direction. Moreover, although not shown in the drawings, it is possible to place another substrate (not shown) in which a flow channel connecting to the first through hole 28 is formed, on the lower surface of the first substrate 20 in FIG. 1. Similarly, it is also possible to place another substrate (not shown) in which a flow channel connecting to the second through hole 38 is formed, on the upper surface of the second substrate 30 in FIG. 1.

Second Embodiment

Figure 2:
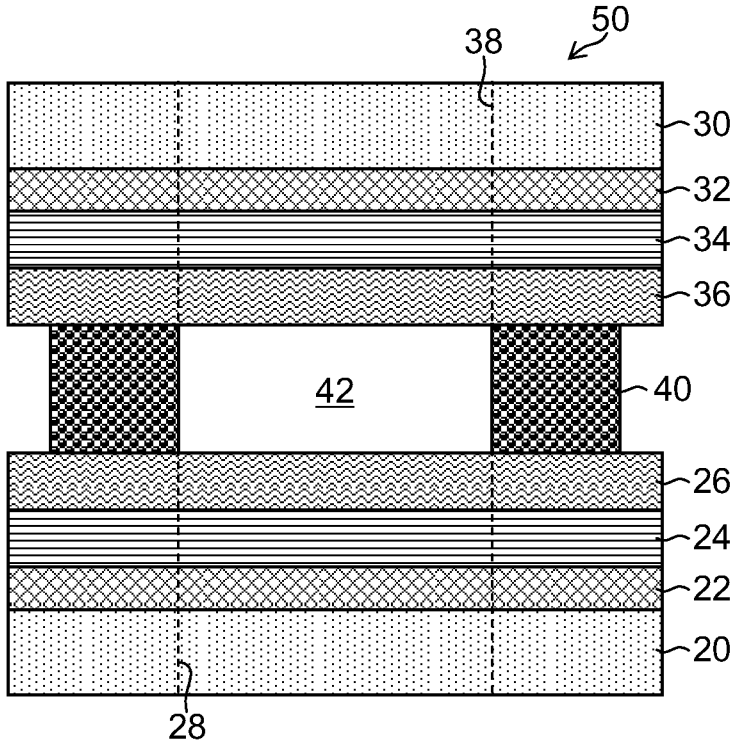
FIG. 2 is a cross-sectional diagram showing a composition of a flow channel structure according to a second embodiment of the present invention.

FIG. 2 is a cross-sectional diagram showing a composition of a flow channel structure according to a second embodiment of the present invention. In FIG. 2, elements which are the same as or similar to the composition described with reference to FIG. 1 are denoted with the same reference numerals and further explanation thereof is omitted here.

In the flow channel structure 50 shown in FIG. 2, a first diffusion blocking layer 24 is arranged between the first adhesive layer 22 and the first Au layer 26, and a second diffusion blocking layer 34 is arranged between the second adhesive layer 32 and the second Au layer 36. The first diffusion blocking layer 24 has a function of preventing diffusion (movement) of Au atoms from the first Au layer 26 into the first adhesive layer 22 during the heating and compressing process to form the Au tubular structure 40, and hence has an effect of improving the adhesiveness between the first Au layer 26 and the first adhesive layer 22. Similarly, the second diffusion blocking layer 34 has a function of preventing diffusion (movement) of Au atoms from the second Au layer 36 into the second adhesive layer 32 during the heating and compressing process to form the Au tubular structure 40, and hence has an effect of improving the adhesiveness between the second Au layer 36 and the second adhesive layer 32. Thus, the first and second diffusion blocking layers 24 and 34 prevent detachment of the layers.

It is desirable that the first and second diffusion blocking layers 24 and 34 are composed of noble metal, from the viewpoint of reactivity. For example, it is desirable that layers of at least one of Pt, Ir, Ru and oxides of these, are formed as the first and second diffusion blocking layers 24 and 34.

The flow channel structure 50 in the second embodiment has further improved durability compared to the flow channel structure 10 in the first embodiment.

Method of Manufacturing Flow Channel Structure

EXAMPLE 1

Here, a method of manufacturing the flow channel structure 50 shown in FIG. 2 is described as a concrete example.

The flow channel structure 50 was manufactured by the following procedure.

<Step 1> A laminated wafer substrate (constituted of Si wafers bonded together) having flow channels previously formed therein was prepared. The wafer substrate corresponds to the first substrate 20.

<Step 2> A Ti layer, a Pt layer and an Au layer were formed by sputtering, successively on the surface of the wafer substrate. The Ti layer corresponds to the first adhesive layer 22, the Pt layer corresponds to the first diffusion blocking layer 24, and the Au layer corresponds to the first Au layer 26. The thicknesses of the respective layers were as follows; Ti: 20 nm, Pt: 100 nm, and Au: 20 nm. These thicknesses of the layers are examples, and embodiments of the present invention can be implemented by using other thicknesses. The laminate of the Ti, Pt and Au layers functions as the adhesive layer for bonding the Au tubular structure 40 onto the wafer substrate. The adhesive layer constituted of the three-layered laminate can be patterned and formed only in the portion where the Au tubular structure is to be formed at a subsequent stage, or can be formed over the whole surface of the wafer substrate.

<Step 3> Next, a pattern was formed with resist on the wafer substrate (more specifically, onto the Au layer having been formed on the wafer substrate). Au powder having the average particle size of 0.3 μm was embedded into the resist pattern, then a presintering process was performed at 100° C. and the resist was removed. Thereby, an Au tubular structure precursor was formed to have a round tubular shape having an external diameter of 180 μm, an internal diameter of 120 μm and a height of 20 μm. The Au tubular structure precursor formed here ultimately became the Au tubular structure 40 in the later step. The resist pattern served as a mold for shaping the Au powder into the three-dimensional shape of the Au tubular structure precursor, and was patterned in accordance with the shape of the structure that was the object of manufacture.

<Step 4> Thereafter, one side of the through flow channel was made by opening a hole in the wafer substrate by dry etching at a portion corresponding to the hollow portion of the Au tubular structure precursor. Thereby, the hole corresponding to the first through hole 28 was formed in the wafer substrate. The Au content of the Au tubular structure precursor at this stage was not lower than 99 at. %.

<Step 5> Another Si wafer substrate (corresponding to the second substrate 30) to be bonded to the wafer substrate obtained in step 4 was prepared, and a Ti layer, a Pt layer and an Au layer were formed by sputtering, successively on the surface of this second wafer substrate. The Ti layer corresponds to the second adhesive layer 32, the Pt layer corresponds to the second diffusion blocking layer 34, and the Au layer corresponds to the second Au layer 36. The thicknesses of the respective layers were as follows; Ti: 20 nm, Pt: 100 nm, and Au: 20 nm. These thicknesses of the layers can be equal to those described in step 2, or can be varied as appropriate. Moreover, similarly to step 2, the layers can be patterned only in the portion corresponding to the Au tubular structure, or can be formed over the whole surface of the Si wafer substrate without patterning.

<Step 6> A hole was opened by dry etching in the wafer substrate obtained in step 5, to form an opening corresponding to the second through hole 38.

<Step 7> Thereupon, the two wafer substrates described above were aligned and superimposed on each other, and were subjected to a bonding process at a heating temperature of 300° C. and an applied pressure of 50 MPa for one hour, thereby completing a through flow channel wafer assembly. By the process of applying heat and pressure, the Au tubular structure precursor was compressed, and the Au tubular structure 40 shown in FIG. 2 was obtained. For example, the Au tubular structure precursor having the height of 20 μm was compressed by the application of heat and pressure to have the height of 10 μm to 15 μm approximately.

In the bonding process, the applied pressure was 50 MPa and the heating temperature was 300° C. in Example 1; and it is desirable that the applied pressure is not lower than 20 MPa and not higher than 50 MPa, and the heating temperature is not lower than 200° C. and not higher than 300° C. When the Au tubular structure precursor is heated and compressed under these conditions, the individual particles of the Au powder forming the Au tubular structure precursor become bonded to form an Au solid body rather than the assemblage of the Au particles.

In the example described above, the opening corresponding to the second through hole 38 was formed before the two wafer substrates were bonded together; however, the timing of formation of the through hole(s) is not limited in particular, and it is also possible to carry out the hole formation after the two wafer substrates are bonded together, or to carry out the formation of the Au tubular structure precursor by using wafer substrates at least one of which has a previously formed hole.

By carrying out the above-described manufacturing method including the steps 1 to 7, it is possible to manufacture the flow channel structure having the composition shown in FIG. 2. Alternatively, by carrying out the similar manufacturing method while omitting the formation of the diffusion blocking layers (Pt layers) in the steps 2 and 5, it is possible to manufacture the flow channel structure having the composition shown in FIG. 1.

<Durability Confirmation Experiments>

When the through flow channel wafer assembly (corresponding to the flow channel structure) obtained by the above-described manufacturing method including the steps 1 to 7 was immersed in hydrochloric acid of pH 3 for 24 hours and then observed, it was confirmed that the through flow channel wafer assembly was unchanged and the durability was good.

Figure 3:
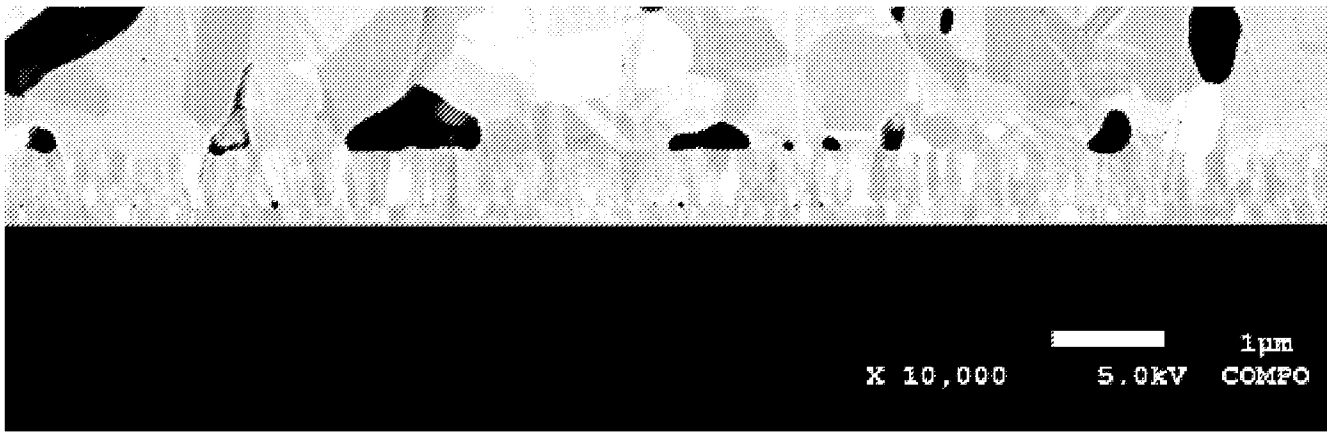
FIG. 3 is an image of a cross section of a joint portion in a flow channel structure obtained in an example according to the present invention.

FIG. 3 shows an image of the sample where a cross section of the joint portion between the Au layer (noble metal layer) and the Au tubular structure in the through flow channel wafer assembly was observed with a scanning electron microscope (SEM). The ratio of the bonded portions in the interface between the Au layer and the Au tubular structure was observed as 60%, and the bonding was good.

<Definition of Ratio of Bonded Portions>

The ratio of the bonded portions in the interface between the Au layer and the Au tubular structure is defined as follows.

The joint portion between the Au tubular structure and the Au layer is observed in a cross section along the axis of the hollow portion of the Au tubular structure. More specifically, the cross section in a plane through which no liquid passes in the flow channel of the Au tubular structure is looked from a side where the liquid could pass, and any field of view in the cross section (here, the field of view shown has a length of approximately 10 μm) is observed to measure the total L1 of the lengths, in the direction along the interface of the Au tubular structure and the Au layer, of the portions at which the Au tubular structure is bonded to the Au layer. The ratio R of the bonded portions is defined as $R\ (\%)=(L1/L)\times 100$, where L is the whole length of the interface between the Au tubular structure and the Au layer within the field of view.

In the case of a flow channel structure that is used as a flow channel through which liquid passes, it is desirable from the viewpoint of preventing leakages of the liquid that the ratio R of the bonded portions is not lower than 50%, more desirably not lower than 60%, and even more desirably not lower than 80%, in any field of view (whichever field of view is observed) within the joint portion between the Au tubular structure and the Au layer.

COMPARATIVE EXAMPLE 1

A structure having a shape similar to that obtained by step 4 in Example 1 was formed on an Si wafer by plating of eutectic Au-20Sn (80 wt % Au and 20 wt % Sn). Then, similarly to Example 1, another Si wafer having the adhesive layer was bonded onto this structure at approximately 280° C. and 20 MPa. When the thus obtained wafer laminated body (a through flow channel wafer assembly) was immersed in hydrochloric acid of pH 3 for 24 hours, corrosion was observed.

COMPARATIVE EXAMPLE 2

Figure 4:
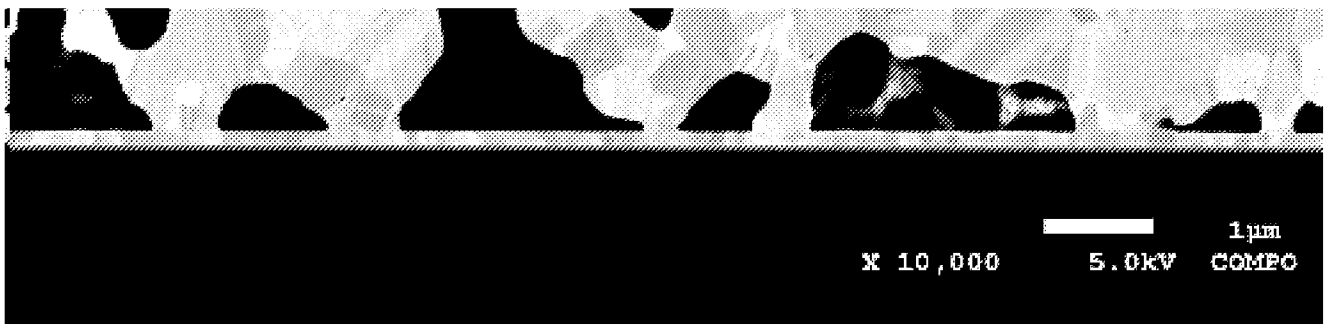
FIG. 4 is an image of a cross section of a joint portion in a flow channel structure obtained in a comparative example.

Wafer substrates to be bonded having a structure made from Au powder similarly to Example 1 were prepared; however, a laminate consisting of a Ti layer of 20 nm and a Pt layer of 100 nm (not provided with any Au layer) was used as each adhesive layer, and apart from this, bonding was carried out under the same conditions as Example 1. When the cross section of the thus obtained bond was observed with the SEM, the ratio of bonded portions was lower than 50%. FIG. 4 shows an image of the sample observed with the SEM. As shown in FIG. 4, there were a large number of voids in the vicinity of the interface of the joint portion, and when liquid was flown through this flow channel, small leaks were observed and the structure was not suitable for the flow channel.

COMPARATIVE EXAMPLE 3

Wafer substrates to be bonded having a structure made from Au powder similarly to Example 1 were prepared; however, a laminate consisting of a Ti layer of 20 nm and a Pt layer of 20 nm was used as each adhesive layer, and apart from this, bonding was carried out under the same conditions as Example 1. This bonded structure peeled apart during handling. The reason for this is thought to be because Au atoms in the Au tubular structure diffused into the Ti layer and the Si layer and were alloyed and thereby adhesiveness at the interface became poor, since there was no noble metal layer having the barrier properties between the Au tubular structure and the adhesive layer.

Composition of Liquid Ejection Head in Embodiment

Figure 5:
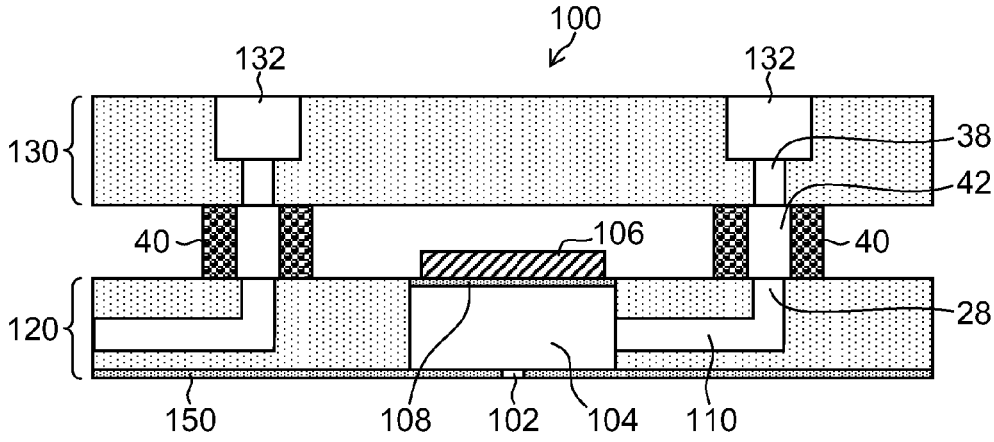
FIG. 5 is a cross-sectional diagram showing a composition of an inkjet head according to an embodiment of the present invention.

FIG. 5 is a cross-sectional diagram showing a composition of an inkjet head according to an embodiment of the present invention. In FIG. 5, elements which are the same as or similar to the composition described with reference to FIGS. 1 and 2 are denoted with the same reference numerals, and description thereof is omitted here.

The inkjet head 100 shown in FIG. 5 includes: a nozzle 102, which forms an ink ejection port; a pressure chamber (ink cavity) 104, which is filled with ink that is to be ejected through the nozzle 102; and a piezoelectric element 106 (serving as an ejection energy generating element), which is arranged correspondingly to the pressure chamber 104. Although the detailed composition of the piezoelectric element 106 is not illustrated, the piezoelectric element 106 is constituted of a lower electrode arranged on a diaphragm 108, a piezoelectric body arranged on the lower electrode, and an upper electrode arranged on the piezoelectric body. Here, the ejection mechanism corresponding to one nozzle 102 only is depicted, but the inkjet head 100 is provided with a plurality of similar ejection mechanisms and a plurality of nozzles 102.

An internal flow channel 110, through which the ink is supplied to the pressure chamber 104, is formed in the inkjet head 100. The internal flow channel 110 functions as a restrictor section (the narrowest part) of an individual supply channel, through which the ink is sent to the pressure chamber 104. The internal flow channel 110, and the first through hole 28 and the pressure chamber 104, which are connected to the internal flow channel 110, and the like are formed in an Si structure 120 (hereinafter referred to as the lower Si structure). The lower Si structure 120 can be constituted of a single Si substrate or a laminated structure formed by layering and bonding together a plurality of Si substrates.

Another Si structure 130 (hereinafter referred to as the upper Si structure) is bonded on the lower Si structure 120 through the Au tubular structure 40. The upper Si structure 130 can be constituted of a single Si substrate or a laminated structure formed by layering and bonding together a plurality of Si substrates.

The lower Si structure 120 includes a member corresponding to the first substrate 20 described with reference to FIGS. 1 and 2, and is formed with the hole corresponding to the first through hole 28. The upper Si structure 130 includes a member corresponding to the second substrate 30 described with reference to FIGS. 1 and 2, and is formed with the hole corresponding to the second through hole 38.

Although not shown in FIG. 5, the first adhesive layer 22 and the first Au layer 26 described with reference to FIG. 1, or the first adhesive layer 22, the first diffusion blocking layer 24 and the first Au layer 26 described with reference to FIG. 2 are arranged on the lower Si structure 120 at the interface with the Au tubular structure 40. Moreover, the second adhesive layer 32 and the second Au layer 36 described with reference to FIG. 1, or the second adhesive layer 32, the second diffusion blocking layer 34 and the second Au layer 36 described with reference to FIG. 2 are arranged on the upper Si structure 130 at the interface with the Au tubular structure 40.

Thus, the inkjet head 100 in the present embodiment has the structure formed by layering together the lower Si structure 120 including a nozzle plate 150 in which the nozzle 102 is formed, the Au tubular structure 40 and the upper Si structure 130.

In FIG. 5, holes 132 opening in the upper surface of the upper Si structure 130 are ink inlet ports, through which the ink is supplied. As shown in FIG. 5, each flow channel, in which the ink passes through the ink inlet port 132, the second through hole 38, the hollow portion 42 of the Au tubular structure 40 and the first through hole 28, is linearly formed in the downward direction perpendicular to the substrates.

The ink entering from the ink inlet port 132 is supplied to the pressure chamber 104 through the internal flow channel 110. The diaphragm 108 constitutes a portion of the faces of the pressure chamber 104 (in FIG. 5, the ceiling face). When a drive voltage is applied to the upper electrode (individual electrode) of the piezoelectric element 106 that is bonded to the diaphragm 108, the piezoelectric element 106 deforms, the volume of the pressure chamber 104 changes, and the consequent pressure change causes the ink in the pressure chamber 104 to be ejected through the nozzle 102.

Although only the ink supply flow channel is depicted in FIG. 5, the inkjet head 100 has a composition by which the ink is circulated inside the inkjet head 100, holes (not shown) serving as ink outlet ports are arranged in the upper surface of the upper Si structure 130, and circulation (recovery) flow channels including the Au tubular structures similar to the supply flow channels are formed. More specifically, the recovery flow channel, through which the ink is recovered (circulated), is connected to each pressure chamber 104 in the lower Si structure 120, and the ink can be circulated to the ink outlet ports of the upper Si structure 130 through the ink flow channels in the ink recovery system including the Au tubular structures similarly to the ink supply system described above.

Advantages of the Present Embodiment

According to the present embodiment, it is possible to obtain micro flow channels which can convey both strongly alkaline ink and strongly acid ink and have high durability regardless of the type of ink conveyed. Moreover, according to the present embodiment, it is possible to obtain stable flow channels which are free of liquid leaks over a long period of time.

Modification Embodiment 1

As to the ejection energy generating elements, it is possible to use heating elements or electrostatic actuators instead of the piezoelectric elements in the embodiment described with reference to FIG. 5.

Modification Embodiment 2

Flow channel structures according to embodiments of the present invention can also be used to convey liquids other than ink for the inkjet system, with similarly good durability. Moreover, flow channel structures according to embodiments of the present invention can also be used to convey fluids such as gasses not only liquids.

Modification Embodiment 3

As to the substrates, it is possible to use substrates made of materials other than Si, instead of the Si substrates in the above-described embodiments.

For example, it is possible to use substrates made of metal materials, such as stainless steel, titanium, aluminum, or the like, or glass materials. Furthermore, it is also possible to use substrates made of heat-resistant resins, such as polyimides (PI), polyphenylene sulfide (PPS), polyether ether ketone (PEEK), or the like, or one of these resins with added filler.

Further Application of Embodiment of the Present Invention

The application of the embodiments of the present invention to the inkjet head has been described above, but the scope of application of the present invention is not limited to this. For example, embodiments of the present invention can be applied widely to micro flow channel structures in various fields, such as heat sink flow channels in central processing units (CPU), micro-total analysis systems (μ-TAS), and the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A flow channel structure, comprising:

a first substrate in which a first flow channel section is arranged;

a first adhesive layer which is arranged on the first substrate;

a first noble metal layer which contains gold and is arranged over the first adhesive layer on the first substrate;

a second substrate in which a second flow channel section is arranged;

a second adhesive layer which is arranged on the second substrate;

a second noble metal layer which contains gold and is arranged over the second adhesive layer on the second substrate; and an Au tubular structure which is disposed between the first and second noble metal layers which face to each other across the Au tubular structure, the Au tubular structure having a hollow portion serving as a connecting flow channel section which connects the first and second flow channel sections, a gold content of the Au tubular structure being not lower than 90 atomic percent (at. %).

2. The flow channel structure as defined in claim 1, wherein the first flow channel section, the hollow portion of the Au tubular structure and the second flow channel section form a flow channel through which liquid passes.

3. The flow channel structure as defined in claim 1, wherein the gold content of the Au tubular structure is not lower than 99 at. %.

4. The flow channel structure as defined in claim 1, wherein the Au tubular structure is formed by molding Au powder and then heating and compressing the molded Au powder.

5. The flow channel structure as defined in claim 1, wherein each of the first and second substrates is made of silicon.

6. The flow channel structure as defined in claim 1, wherein each of the first and second adhesive layers contains one of titanium, nickel, chromium and zirconium.

7. The flow channel structure as defined in claim 1, further comprising:

a first diffusion blocking layer which is arranged between the first noble metal layer and the first adhesive layer, the first diffusion blocking layer preventing diffusion of gold atoms from the first noble metal layer into the first adhesive layer; and a second diffusion blocking layer which is arranged between the second noble metal layer and the second adhesive layer, the second diffusion blocking layer preventing diffusion of gold atoms from the second noble metal layer into the second adhesive layer.

8. The flow channel structure as defined in claim 7, wherein each of the first and second diffusion blocking layers contains one of platinum, iridium and ruthenium or any oxide of platinum, iridium and ruthenium.

9. The flow channel structure as defined in claim 1, wherein when each of a first interface between the Au tubular structure and the first noble metal layer and a second interface between the Au tubular structure and the second noble metal layer is observed in a cross section taken along an axis of the hollow portion of the Au tubular structure, a ratio R of bonded portions is not lower than 50% in each of the first and second interfaces, where the ratio R is defined as $R(\%)=(L1/L)\times 100$, L is a whole length of each of the first and second interfaces in the cross section within a field of view, and L1 is a total of lengths, taken along each of the first and second interfaces in the cross section within the field of view, of portions at which the Au tubular structure is bonded to corresponding one of the first and second noble metal layers.

10. A liquid ejection head, comprising:

the flow channel structure as defined in claim 1;

a pressure chamber which is configured to store liquid and is connected to a flow channel constituted of the flow channel structure through which the liquid is supplied to the pressure chamber;

a nozzle which is configured to be an ejection port through which the liquid in the pressure chamber is ejected; and an ejection energy generating element which is arranged correspondingly to the pressure chamber and is configured to generate energy for ejecting a droplet of the liquid through the nozzle.

* * * * *